US011540632B2

(12) United States Patent
Zhang

(10) Patent No.: US 11,540,632 B2
(45) Date of Patent: Jan. 3, 2023

(54) FOOTREST MECHANISM, CHAIR SUPPORT BODY HAVING SAME AND CHAIR

(71) Applicant: Xiaozhao Zhang, Chuzhou (CN)

(72) Inventor: Xiaozhao Zhang, Chuzhou (CN)

( * ) Notice: Subject to any disclaimer, the term of this patent is extended or adjusted under 35 U.S.C. 154(b) by 0 days.

(21) Appl. No.: 17/213,226

(22) Filed: Mar. 26, 2021

(65) Prior Publication Data

US 2022/0071396 A1 Mar. 10, 2022

(30) Foreign Application Priority Data

Sep. 8, 2020 (CN) ..... 202021949627.9

(51) Int. Cl.
*A47C 1/0355* (2013.01)
*A47C 7/50* (2006.01)
*A61G 5/14* (2006.01)

(52) U.S. Cl.
CPC ..... *A47C 1/0355* (2013.01); *A47C 7/5068* (2018.08); *A61G 5/14* (2013.01)

(58) Field of Classification Search
CPC ..... A47C 1/0355; A47C 7/5068; A61G 5/14
See application file for complete search history.

(56) References Cited

U.S. PATENT DOCUMENTS 5,219,204 A * 6/1993 Bathrick ..... A61G 5/14 297/DIG. 10
5,312,153 A * 5/1994 Lin ..... A47C 1/0345 297/DIG. 10
5,651,580 A * 7/1997 LaPointe ..... A61G 5/14 297/DIG. 10
9,351,576 B1 * 5/2016 Rogers ..... A47C 1/0355
2006/0238007 A1 * 10/2006 Lin ..... A61G 5/14 297/330
2012/0299363 A1 * 11/2012 Crum ..... A47C 1/0352 297/85 M
2018/0078039 A1 * 3/2018 LaPointe ..... A47C 1/0355
2020/0216179 A1 * 7/2020 Last ..... B64D 11/0643

* cited by examiner

*Primary Examiner* — David R Dunn
*Assistant Examiner* — Tania Abraham

(57) ABSTRACT

A footrest mechanism, comprising a chair support body, a locking component and a leg component. The locking component comprises a locking rod, a locking arm and a locking elastic member. The locking rod is pivotally connected to the chair support structure. The locking arm is pivotally connected to the leg component and the locking rod, respectively. The locking elastic member is connected to the chair support structure and the locking arm, respectively. The locking arm can be locked to the chair support structure to define a locking state and the locking state can be maintained due to an elastic deformation of the locking elastic member. The leg component is pivotally connected to the chair support structure and in a transmission connection with a driving component, and the leg component is capable of rotating relative to the chair support structure when the leg component is driven by the driving component.

11 Claims, 7 Drawing Sheets

FOOTREST MECHANISM, CHAIR SUPPORT BODY HAVING SAME AND CHAIR

CROSS-REFERENCE TO RELATED APPLICATION

This application claims all benefits accruing under 35 U.S.C. § 119 from China Patent Application No. 202021949627.9, filed on Sep. 8, 2020, and titled "FOOTREST MECHANISM, CHAIR SUPPORT BODY HAVING SAME AND CHAIR", in the China National Intellectual Property Administration, the content of which is hereby incorporated by reference.

TECHNICAL FIELD

The present disclosure relates to chairs, in particular to a footrest mechanism, a chair support body having the same and a chair.

BACKGROUND

A chair support body is a mechanical device disposed inside a chair or a sofa. The conventional chair support body is commonly provided with a footrest mechanism capable of rotating relative to a chair support structure, and a driving component configured for driving the footrest mechanism to move. The footrest mechanism can be driven by the driving component to expand or contract relative to the chair support structure, so as to raise up or lower legs of a user. When the footrest mechanism is contracted relative to the chair support structure, it is difficult for the footrest mechanism to maintain a relative position between the footrest mechanism and the chair support structure. The footrest mechanism may even move relative to the chair support structure, thereby causing the footrest mechanism to impact the chair support structure.

Therefore, the user may feel not stable, and have a poor user's experience.

SUMMARY

It is necessary to provide an improved footrest mechanism, a chair support body having the same, and a chair.

The present disclosure provides a footrest mechanism, including a chair support structure, a locking component and a leg component. The locking component includes a locking rod, a locking arm and a locking elastic member. The locking rod is pivotally connected to the chair support structure. The locking arm is pivotally connected to the leg component and the locking rod, respectively. The locking elastic member is connected to the chair support structure and the locking arm, respectively. The locking arm can be locked to the chair support structure to define a locking state and the locking state can be maintained due to an elastic deformation of the locking elastic member. The leg component is pivotally connected to the chair support structure and in transmission connection with a driving component. The leg component is capable of rotating relative to the chair support structure when the leg component is driven by the driving component. The leg component has a contracting state and is capable of driving the locking arm to move towards the locking rod; wherein the locking elastic member is capable of maintaining relative position of the locking arm and the chair support structure. The leg component further has an expanding state and is further capable of driving the locking arm to move away from the locking rod, resulting in the locking state of the locking arm and the chair support structure being released.

Furthermore, the locking rod is provided with a locking and limiting structure; and when the locking rod and the locking arm are folded therebetween, the locking and limiting structure is configured for limiting the locking arm. In other embodiments, the locking arm is provided with the locking and limiting structure; and when the locking rod and the locking arm are folded therebetween, the locking and limiting structure is configured for limiting the locking rod.

Therefore, when the locking and limiting structure limits one of the locking rod and the locking arm, the locking arm and the locking rod cannot move towards each other, and relative position therebetween can be maintained. In this state, the locking elastic member can lock the locking arm, so as to ensure that the locking and limiting structure can abut against one of the locking rod and the locking arm. The locking arm, the locking rod and the locking elastic member can define a stable structure, so that the locking elastic member can lock the relative position between the locking arm and the chair support structure.

Furthermore, the locking and limiting structure is a locking protrusion which is fixed on the locking rod and when the locking rod and the locking arm are folded therebetween, the locking protrusion abuts against the locking arm.

Therefore, the locking protrusion can have a simple structure, and can effectively limit the locking arm. It is easy to produce the locking rod.

Furthermore, a joint between the locking elastic member and the chair support structure can be switched, and a joint between the locking elastic member and the locking arm can be switched, so that the elastic deformation of the locking elastic member is adjusted.

Therefore, when the locking arm and the locking rod are in the contracting state, the elastic deformation of the locking elastic member can be adjusted. Moreover, connecting positions of the locking arm and the locking elastic member can be indirectly adjusted by adjusting positions of a pivot point between the locking arm and the leg component. This is easier for the user to adjust the chair, and the user can save a lot of time. In addition, connecting positions of the locking elastic member and the chair support structure can be adjusted by removing a fixing lug seat. This is easier and more convenient for the user to adjust the chair, and can prevent the user for injuring caused by directly adjusting the locking elastic member.

Furthermore, the locking arm is provided with a plurality of first connecting portions or a plurality of first connecting holes. Each of the plurality of first connecting portions or each of a plurality of first connecting holes is configured for connecting to the locking elastic member. The chair support structure can be provided with the fixing lug seat, which is detachably fixed to the chair support structure. The fixing lug seat is provided with a plurality of second connecting portions or a plurality of second connecting holes, and each of a plurality of second connecting portion or each of a plurality of second connecting hole is configured for connecting to the locking elastic member. In other embodiments, the leg component can be provided with a plurality of pivot locking holes, and each of a plurality of pivot locking holes is configured for pivotally connected to the locking arm.

Furthermore, the number of the footrest mechanism is two. The driving component includes a first linking element and a chair driving motor. The first linking element is configured for connecting the two sets of footrest mechanisms, and is in transmission connection with the chair driving motor via the first linking element. The first linking element is driven by the chair driving motor to drive the two sets of footrest mechanism to move correlatively.

Therefore, the two sets of footrest mechanism can more stably support the user. Besides, the two sets of footrest mechanisms can facilitate covering leather or other supporting mechanisms on the chair support body and the chair having the footrest mechanism. Therefore, when using the chair, the user can sit on the supporting mechanism between the two sets of footrest mechanisms, thereby preventing the user from losing balance and even falling off from the chair support structure.

The present disclosure further provides a chair support body, including the driving component, a transmission component, a lifting mechanism and the above footrest mechanism. The driving mechanism is disposed on a base, and is in transmission connection with the leg component via the transmission component. The lifting mechanism is located to the base and fixed to the chair support structure.

Furthermore, the lifting mechanism includes a first substrate, a second substrate, a first lifting rod and a second lifting rod. The first substrate is fixed to the chair support structure. Two ends of the first lifting rod are pivotally connected to the first substrate and the second substrate, respectively. Two ends of the second lifting rod are pivotally connected to the first substrate and the second substrate, respectively. The second substrate is connected to the base. A first four-rod mechanism is defined by the first substrate, the first lifting rod, the second lifting rod and the second substrate. When the first four-rod mechanism is driven by the driving component, the first four-rod mechanism is capable of moving away from the base, or moving towards the base.

Therefore, the lifting mechanism can have a determined moving trace, so that the footrest mechanism and the transmission component can be raised up or put down together, thereby switching the chair between a standing state and a sitting state.

Furthermore, the first substrate is a forging plate.

Therefore, the first substrate can have better rigidity and strength, which can better bear extruding force generated when the first lifting rod and the second lifting rod moves, and can be not easy to bend after being used in several times. In addition, when the chair is in the lying state or the sitting state, the forging plate can ensure the first substrate to reliably abut against a base of the chair, making the first substrate more stable and durable.

Furthermore, the driving component includes the chair driving motor and the first linking element, the first linking element is pivotally connected to an output terminal of the chair driving motor, and is cooperatively connected to the first substrate. The first linking element is driven by the chair driving motor to drive the first four-rod mechanism to expand or contract.

Therefore, the driving component can not only drive the leg component to expand or contract relative to the chair support structure, but also drive the entire footrest mechanism to be raised up or put down. The chair can be driven by an electrical motor, so that it can be simpler and more convenient for the user to adjust the chair.

Furthermore, the transmission component includes a first connecting rod, a second connecting rod, a third connecting rod and an energy output member. The first connecting rod is pivotally connected to the lifting mechanism and connected to the driving component. Two ends of the second connecting rod are pivotally connected to the first connecting rod and the third connecting rod, respectively. An end of the third connecting rod away from the second connecting rod is pivotally connected to the chair support structure. Two ends of the energy output member are pivotally connected to the second connecting rod and the leg component, respectively.

Therefore, the driving component is in transmission connection with the leg component via the transmission component. Besides, the transmission component has a simpler structure, and the chair support body has a lower cost.

Furthermore, the driving component further includes a backrest driving motor, which is connected to the base. The chair support body further includes a backrest component, which is connected to and driven by the backrest driving motor. The backrest component includes a backrest element and a second linking element, wherein the backrest element is pivotally connected to the chair support structure and fixed to the second linking element, and the second linking element is pivotally connected to an output terminal of the backrest driving motor.

Therefore, since the chair support body is provided with two electrical motors including the chair driving motor and the backrest driving motor, the expanding and contracting of the leg component relative to the chair support structure can be adjusted and the angle defined by the chair backrest can be adjusted, respectively, and such adjustments can be more orderly.

Furthermore, the chair support structure includes two sets of lifting mechanisms, and the driving component is capable of driving the two sets of lifting mechanisms to correlatively expand or correlatively contract.

Therefore, the chair can be more stable and safer while the lifting mechanism is driving the chair support structure to move or lifting the chair support structure.

The present disclosure further provides a chair, including the base and the chair support body illustrated above.

In the present disclosure, the footrest mechanism can be driven by the driving component and automatically locked. When the locking component is driven by the leg component to contract, the leg component can be folded more firmly under the react of the locking component, and the leg component can be maintained at a fixed position. This can avoid the leg component to move relative to the chair support structure, and the using experience can be better. In addition, the leg component can be further driven by the driving component. The locking component can be driven by the leg component to release the locking state of the leg component and the chair support structure. Therefore, the chair is more convenient to use.

10 represents a chair support structure; 11 represents a fixing lug seat; 12 represents a torsion resistance fixing member; 13 represents a first support portion; 14 represents a second support portion; 20 represents a locking component; 21 represents a locking rod; 22 represents a locking arm; 23 represents a locking elastic member; 24 represents a locking protrusion; 30 represents a leg component; 31 represents a first leg connecting rod; 32 represents a second leg connecting rod; 33 represents a third leg connecting rod; 34 represents a fourth leg connecting rod; 35 represents a leg support member; 36 represents a first leg four-rod mechanism; 37 represents a second leg four-rod mechanism; 211 represents a chair driving motor; 2111 represents a push rod; 2112 represents a motor housing; 212 represents a first linking element; 2121 represents a sector-shaped plate; 2122 represents a first pin-shaft; 2123 represents a second pin-shaft; 213 represents a backrest driving motor; 214 represents a second linking element; 221 represents a first connecting rod; 222 represents a second connecting rod; 223 represents a third connecting rod; 224 represents an energy output member; 230 represents a lifting mechanism; 231 represents a first substrate; 2311 represents a sliding groove; 232 represents a second substrate; 233 represents a first lifting rod; 234 represents a second lifting rod; 235 represents a third linking element; 236 represents a fourth linking element; 241 represents a backrest element; 300 represents a chair; 310 represents a seat; 311 represents a U-shaped seat.

DETAILED DESCRIPTION

The technical solutions in the embodiments of the present disclosure are clearly and completely described in the following with reference to the accompanying drawings in the embodiments of the present disclosure. It is obvious that the described embodiments are only a part of the embodiments, but not all of the embodiments. All other embodiments obtained by those skilled in the art based on the embodiments of the present disclosure without departing from the inventive scope are the scope of the present disclosure.

All technical and scientific terms used herein have the same meaning as commonly understood by one of ordinary skill in the art to which this disclosure is claimed. The terminology used in the description herein is for the purpose of describing particular embodiments, and is not intended to limit the disclosure. The term "or/and" as used herein includes any and all combinations of one or more of the associated listed items.

Figure 1:
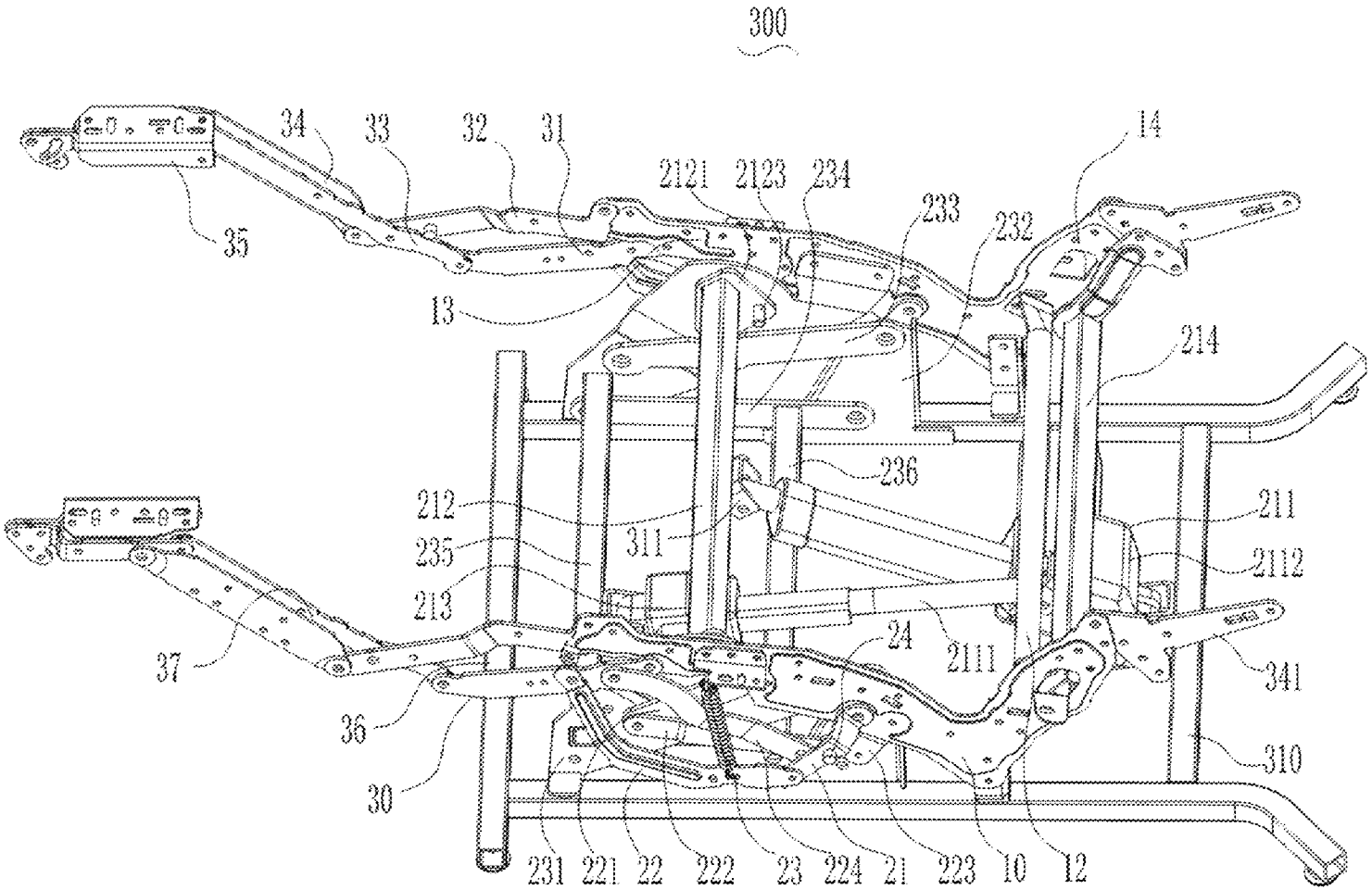
FIG. 1 is a structural schematic view of a chair in an expanding state in one embodiment of the present disclosure.
Figure 2:
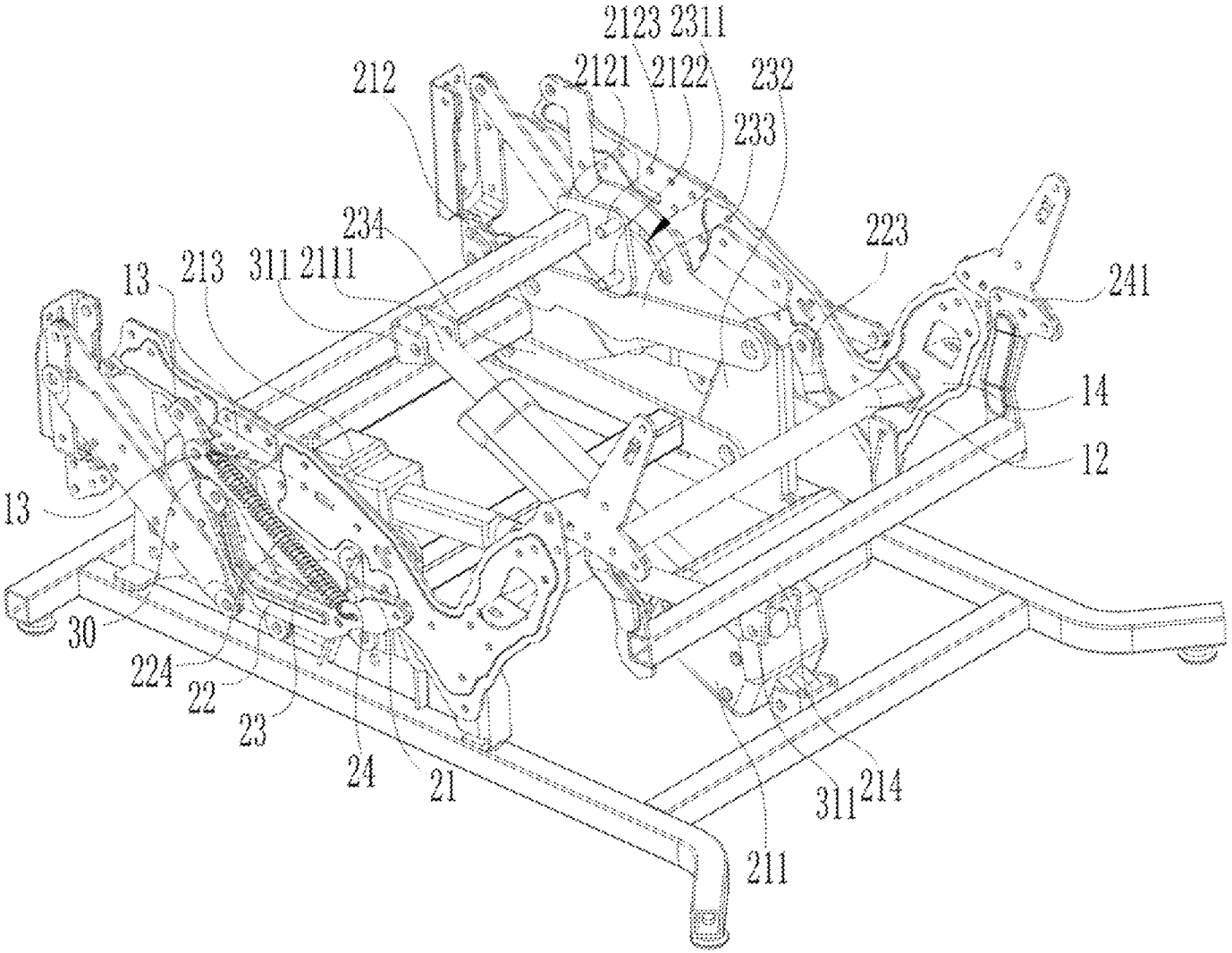
FIG. 2 is a structural schematic view of a chair in a contracting state in another embodiment of the present disclosure.
Figure 3:
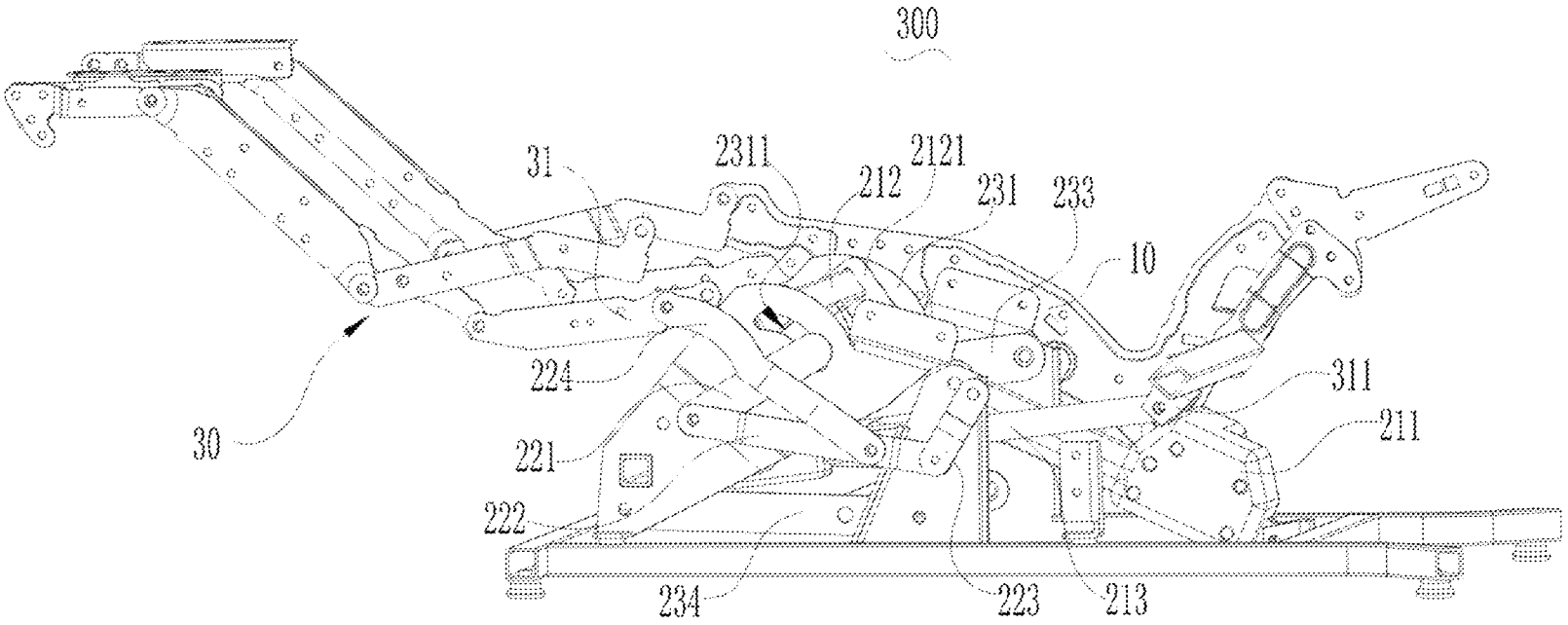
FIG. 3 is a structural schematic view of a part of a chair in an expanding state in another embodiment of the present disclosure.

FIG. 1 is a structural schematic view of a chair 300 in an expanding state in one embodiment of the present disclosure, FIG. 2 is a structural schematic view of a chair 300 in a contracting state in another embodiment of the present disclosure, and FIG. 3 is a structural schematic view of a part of a chair 300 in an expanding state in another embodiment of the present disclosure.

The present disclosure provides a footrest mechanism, a chair support body having the same, and a chair 300. The footrest mechanism can move relative to the chair support body, so that the chair 300 can be adjusted between different sitting states by a user. The chair support body can be disposed on a base 310 and further disposed in the chair 300, defining a movement skeleton of the chair 300.

The footrest mechanism can include a chair support structure 10, a locking component 20 and a leg component 30. The leg component 30 can be pivotally connected to the chair support structure 10, and in transmission connection with the driving component, and can be driven by the driving component to rotate relative to the chair support structure 10. When the leg component 30 rotates relative to the chair support structure 10, the leg component 30 can move towards or away from the chair support structure 10, so that the leg component 30 can contract or expand. The driving component can be disposed in a chair support body having the footrest mechanism. For the sake of ensuring stable moving of the driving component and providing stable driving force, the driving component can be disposed on the base 310 of the chair 300, and in transmission connection with the leg component 30 via a transmission component disposed in the chair support body. The chair support structure 10 can be a main support component of the chair support body in the present disclosure, and can be configured for defining the support skeleton of the chair 300. The chair support structure 10 can support the back, the body and the arms of the user, and can be a mounting base of the leg component 30 and the locking component 20 of the footrest mechanism.

In some embodiments, the chair support structure 10 can be an L-shaped plate including a first support portion 13 and a second support portion 14, which can define an angle and be integrally prepared. The first support portion 13 can be a mounting base of the leg component 30, the locking component 20 and the transmission component in the chair support body. The second support portion 14 can be configured for supporting the back of the user, or disposing the backrest element 241 for supporting the back of the user.

Furthermore, the leg component 30 can include a first leg connecting rod 31, a second leg connecting rod 32, a third leg connecting rod 33, a fourth leg connecting rod 34 and a leg support member 35. Both the first leg connecting rod 31 and the second leg connecting rod 32 can be pivotally connected to the chair support structure 10. The third leg connecting rod 33 can be pivotally connected to an end of the first leg connecting rod 31 away from the chair support structure 10. The fourth leg connecting rod 34 can be pivotally connected to an end of the second leg connecting rod 32 away from the chair support structure 10. The leg support member 35 can be pivotally connected to an end of the third leg connecting rod 33 away from the first leg connecting rod 31, and can be pivotally connected to an end of the fourth leg connecting rod 34 away from the second leg connecting rod 32. The second leg connecting rod 32 and the third leg connecting rod 33 can be pivotally connected and crossed with each other. Therefore, a first leg four-rod mechanism 36 can be defined by the chair support structure 10, the first leg connecting rod 31, the second leg connecting rod 32 and the third leg connecting rod 33. At the same time, a second leg four-rod mechanism 37 can be defined by the second leg connecting rod 32, the third leg connecting rod 33, the fourth leg connecting rod 34 and leg support member 35. The two four-rod mechanisms (i.e. the first leg four-rod mechanism 36 and the second leg four-rod mechanism 37) can correlatively expand or correlatively contract, so that the entire leg component 30 can expand or contract.

Of course, in other embodiments, the leg component 30 can be other kinds of link mechanisms, and can be not limited to two correlative four-rod mechanisms, or including the leg connecting rods. The structure of the leg component 30 is not claimed in the present disclosure, and will not be described in details hereinafter. The structure of the leg component 30 in the present embodiment will be described hereinafter as an example.

Furthermore, the driving component can include a chair driving motor 211. In some embodiments, the chair driving motor 211 can be a push rod motor, including a motor housing 2112 and a pushing rod 2111. The motor housing 2112 can be pivotally connected to the base 310 of the chair 300, and the push rod 2111 can contract and expand relative to the motor housing 2112. As an output terminal of the chair driving motor 211, the push rod 2111 can provide a stable expanding and contracting driving force while the push rod 2111 moving relative to the motor housing 2112. The transmission component can be pivotally connected to the push rod 2111 of the chair driving motor 211, and connected to the first leg connecting rod 31 of the leg component 30. When the push rod 2111 is driven by the chair driving motor 211 to contract towards the motor housing 2112, the transmission component can be driven by the push rod 2111 to drive the first leg connecting rod 311 to rotate away from the chair support structure 10. At the same time, the first leg four-rod mechanism 36 and the second leg four-rod mechanism 37 can be driven to correlatively expand, and the leg support member 35 can be finally stuck out to support legs of the user. When the push rod 2111 is driven by the chair driving motor 211 to stuck out from the motor housing 2112, the transmission component can be driven by the push rod 2111 to drive the first leg connecting rod 31 to rotate towards the chair support structure 10. At the same time, the first leg four-rod mechanism 36 and the second leg four-rod mechanism 37 can be driven to correlatively contract, and the leg support member 35 can be finally drawn back. Therefore, the leg support member 35 can contract and be accommodated near the chair support structure, so that the user can put his legs off and leave the chair.

It should be illustrated that "the first leg connecting rod 31 rotates along a direction away from the chair support structure 10" represents that when the first leg connecting rod 31 rotates relative to the chair support structure 10, the end of the first leg connecting rod 31 away from the chair support structure 10 can move away from the chair support structure 10, so that the entire first leg connecting rod 31 can move away from the chair support structure 10. Therefore, "the first leg connecting rod 31 rotates along a direction towards the chair support structure 10" represents that when the first leg connecting rod 31 rotates relative to the chair support structure 10, the end of the first leg connecting rod 31 relative away from the chair support structure 10 can move towards the chair support structure 10, so that the entire first leg connecting rod 31 can move towards the chair support structure 10. In the present disclosure, movement of other similar elements will not be described in detail hereinafter.

The locking component 20 can be movably connected to the first leg connecting rod 31 and the chair support structure 10, respectively. When the first leg connecting rod 31 is driven by the chair driving motor 211 to move along the direction away from the chair support structure 10 and expand, the first leg connecting rod 31 can drive the locking component 20 to move and expand at the same time. When the leg component 30 is driven by the chair driving motor 211 to move along the direction towards the chair support structure 10, the first leg connecting rod 31 can drive the locking component 20 to move and fold at the same time until the locking component 20 is in the contracting state. When the locking component 20 is in the contracting state, the locking component 20 is capable of maintaining relative position of the first leg connecting rod 31 and the chair support structure 10, and maintaining the contracting state of the first leg connecting rod 31 due to the locking component 20. When the leg component 30 is driven by the chair driving motor 211 to move and expand again, the locking component 20 can be driven by the first leg connecting rod 31 again to move, so as to release the locking state between the first leg connecting rod 31 and the chair support structure 10.

In some embodiments, the locking component 20 can include a locking rod 21, a locking arm 22 and a locking elastic member 23. The locking rod 21 can be pivotally connected to the chair support structure 10. The locking arm 22 can be pivotally connected to the leg component 30 and the locking rod 21, respectively. The locking elastic member 23 can be connected to the chair support structure 10 and the locking arm 22, respectively. The locking arm 22 can be locked to the chair support structure 10 to define a locking state and the locking state can be maintained due to an elastic deformation of the locking elastic member 23.

In some embodiments, two ends of the locking elastic member 23 can be provided with an adjustable spring having a hook. Two hooks disposed at two ends of the locking elastic member 23 can be clasped on the connecting holes disposed on the chair support structure 10 and the locking arm 22. In other embodiments, rivets can be disposed on at least one of the chair support structure 10 the locking arm 22, on which the locking elastic member 23 can be clasped.

When the user wants to leave the chair 300, the transmission component can be electrically driven by the chair driving motor 211 to drive the first leg connecting rod 31 to rotate relative to the chair support structure 10. Therefore, the first leg connecting rod 31 can drive the locking arm 22 to move, and the locking arm 22 can be driven to move towards the locking rod 21, until the two cannot be folded any more, and the relative position between the locking arm 22 and the locking rod 21 can be maintained. At this time, the locking arm 22 can be locked due to an elastic deformation of the locking elastic member 23, so that the relative position between the locking arm 22 and the chair support structure 10 can be maintained. The first leg connecting rod 31 can be pulled by the locking arm 22, thereby maintaining the contracting state of the leg component 30 under the effect of the locking arm 22 and the locking rod 21.

When the user uses the chair 300, the transmission component can be electrically driven by the chair driving motor 211 to drive the first leg connecting rod 31 to rotate away from the chair support structure 10. Therefore, the first leg connecting rod 31 can drive the locking arm 22 to move, so that the locking elastic member 23 can release the locking state of the locking arm 22 and the chair support structure 10. At the same time, the locking arm 22 and the locking rod 21 can be gradually changed to a contracting state from the locking state, until the first leg four-rod mechanism 36 and the second leg four-rod mechanism 37 in the leg component 30 are completely expanded and the legs of the user are raised up by the leg support member 36.

Furthermore, in some embodiment, the locking rod 21 can be provided with a locking and limiting structure. When the locking rod 21 and the locking arm 22 are folded therebetween, the locking and limiting structure can be configured for limiting the locking arm 22. In other embodiments, the locking arm 22 can be provided with the locking and limiting structure. When the locking rod 21 and the locking arm 22 are folded therebetween, the locking and limiting structure can be configured for limiting the locking rod 21. The locking and limiting structure can be configured for limiting the folding of the locking arm 22 and the locking rod 21, so as to avoid unduly folding and even overlapping between the locking arm 22 and the locking rod 21, thereby avoiding unduly folding between the locking component 20 and the entire leg component 30. Therefore, collision and interference of each element in the leg component 30 and the locking component 20 can be avoided, and collision and interference between the leg component 30 and the chair support structure 10 can be further prevented.

When the locking and limiting structure limits one of the locking rod 21 and the locking arm 22, the locking arm 22 and the locking rod 21 cannot move towards each other, and relative position therebetween can be maintained. In this state, the locking elastic member 23 can lock the locking arm 22, so as to ensure that the locking and limiting structure can abut against one of the locking rod 21 and the locking arm 22. The locking arm 22, the locking rod 21 and the locking elastic member 23 can define a stable structure, so that the locking elastic member 23 can lock the relative position between the locking arm 22 and the chair support structure 10.

In some embodiments, the locking and limiting structure can be a locking protrusion 24 which is fixed on the locking rod 21. When the locking rod 21 and the locking arm 22 are folded therebetween, the locking protrusion 24 can abut against the locking arm 22.

Referring to FIG. 2 again, when the locking elastic member 23 is expanded, the locking arm 22 can have a tendency to rotate around the joint of the first leg connecting rod 31 and the locking arm 22 under the effect of the locking force defined by the locking elastic member 23. However, under the limiting effect of the locking protrusion 24 disposed on the locking rod 21, the locking arm can be restricted, so that the locking arm 22 can be stably abutted against a sidewall of the locking protrusion 24 under the effect of the locking elastic member 23, thereby defining an equilibrium state among the locking rod 21, the locking arm 22 and the locking elastic member 23.

Therefore, the locking protrusion 24 can have a simple structure, and can effectively limit the locking arm 22. It is easy to produce the locking rod.

It should be understood that in other embodiments, the locking and limiting structure can be other kinds of elements or structures except the locking protrusion 24. For example, in one embodiment, one of the locking arm and the locking rod can include a slot and the other of the locking arm and the locking rod can include a clamping portion matching with the slot. When the locking arm 22 and the locking rod 21 are folded, the locking arm 22, the locking rod 21 and the locking elastic member 23 can define a relative stable equilibrium state by the operation of the slot and the clamping portion.

Furthermore, in some embodiments, a joint between the locking elastic member 23 and the chair support structure 10 can be switched, and a joint between the locking elastic member 23 and the locking arm 22 can be switched, so that the elastic deformation of the locking elastic member is adjusted. Therefore, when the leg component 30 is driven to contract by the driving component, the joint between the locking elastic member 23 and the chair support structure 10, and the joint between the locking elastic member 23 and the locking arm 22 can be changed by the user. Therefore, when the leg component 30 is contracted, the locking elastic member 23 can have different elastic deformation, so as to obtain different locking forces.

The user can manually adjust the joint between the locking elastic member 23 and the chair support structure 10, or the joint between the locking elastic member 23 and the locking arm 22 according to requirement for contracting the leg component 30. Alternatively, the user can indirectly change the joints of the locking elastic member 23 by adjusting the position of the locking arm 22 and the relative position between the locking arm 22 and the chair support structure 10. Therefore, the locking elastic member 23 can be indirectly adjusted, thereby avoiding the injury of the user.

Therefore, the locking elastic member 23 can be more suitable for a footrest mechanism, the chair support body having the same and the chair 300 having the same. In consideration of safety, the user can increase the elastic deformation of the locking elastic member 23 when locking the locking arm 22 and the chair support structure 10, so as to ensure the locking of the leg component 30. Alternatively, the elastic deformation of the locking elastic member 23 can be decreased, so that the driving component 30 can be more easily to be driven to move.

In some embodiments, the locking arm 22 can be provided with a plurality of first connecting holes. Each of the plurality of first connecting holes can be configured for connecting to the locking elastic member 23. A first leg element of the leg component 30 can be provided with a plurality of pivot locking holes, and each of the plurality of pivot locking holes can be configured for pivotally connected to the locking arm 22. The chair support structure 10 can be provided with a fixing lug seat 11, which can be detachably fixed to the chair support structure 10. The fixing lug seat 11 can be provided with a plurality of second connecting holes, and each of the plurality of second connecting holes can be configured for connecting to the locking elastic member 23.

Therefore, the joints of the locking elastic member 23 on at least one of the locking arm 22 and the chair support structure 10 can be adjusted. When the locking arm 22 and the locking rod 21 are in the contracting state, the elastic deformation of the locking elastic member 23 can be adjusted. Moreover, connecting positions of the locking arm 22 and the locking elastic member 23 can be indirectly adjusted by adjusting positions of a pivot point between the locking arm 22 and the leg component 23. This can be easier for the user to adjust the chair, and the user can save a lot of time. In addition, connecting positions of the locking elastic member 23 and the chair support structure 10 can be adjusted by removing the fixing lug seat 11. This can be easier and more convenient for the user to adjust the chair, and can prevent the user for injuring caused by directly adjusting the locking elastic member.

In some embodiments, the first connecting holes located on the locking arm 22 can be replaced with a plurality of first connecting portions connected to an end of the locking elastic member 23. The second connecting holes located on the fixing lug seat 11 can be replaced with a plurality of second connecting portions connected to another end of the locking elastic member 23. Moreover, the chair support structure 10 can be provided without the fixing lug seat 11. That is, a plurality of the second connecting holes can be directly located on the first support portion 13 of the chair support structure 10.

It should be understood that in some embodiments, one of the plurality of first connecting holes and the plurality of first connecting portions can be located on the locking arm 22. In other embodiments, one of a plurality of second connecting holes and a plurality of second connecting portions can be located on the chair support structure. In other embodiments, a plurality of pivot locking holes can be located on the first leg element; and in other embodiments, there may be a combination of two or three technical solutions above, and can be not limited to the embodiments of the present disclosure, as long as the locking elastic member 23 can have different elastic deformation when the leg component 30 is in the contracting state.

Furthermore, in some embodiments, the chair support body can include two sets of footrest mechanisms. The driving component can further include a first linking element 212. The first linking element 212 can be connected to an output terminal of the chair driving motor 211, and the two sets of footrest mechanisms can be connected via the first linking element 212. The first linking element 212 is driven by the chair driving motor 211 to drive the two sets of footrest mechanism to move correlatively.

In some embodiments, the first linking element 212 can be rods having rectangle cross-sections. The chair driving motor 211 can be disposed between two sets of footrest mechanism, and a push rod 2111 can be pivotally connected to a U-shaped seat 311 fixed to the middle of the first linking element 212. Accordingly, the number of the transmission component can be two. The two sets of transmission components can be symmetrically disposed at two sides of the driving motor 211. The energy input terminal of each set of the transmission component can be fixed to an end of the first linking element 212, and energy output terminal of each set of the transmission component can be connected to the first leg connecting rod 31 in each set of footrest mechanism.

Therefore, the two sets of footrest mechanism can more stably support the user. Besides, the two sets of footrest mechanisms can facilitate covering leather or other supporting mechanisms on the chair support body and the chair having the footrest mechanism. Therefore, when using the chair, the user can sit on the supporting mechanism between the two sets of footrest mechanisms, thereby preventing the user from losing balance and even falling off from the chair support structure.

Furthermore, the chair support body of the present disclosure can further include a lifting mechanism 230. The lifting mechanism 230 can be located to the base 310 of the chair 300, and fixed to the chair support structure 10. The lifting mechanism 230 can be driven by the chair driving motor 211 to move, so as to drive the chair support structure 10 and the entire leg component 30 to rise relative to the base 310 of the chair 300. In this period, the chair support structure 10 can incline to the front of the chair 300 (i.e., the side in which the footrest mechanism is located). The chair is changed to the standing state from the lying state of the sitting state, so that the user can leave the chair 300.

Figure 4:
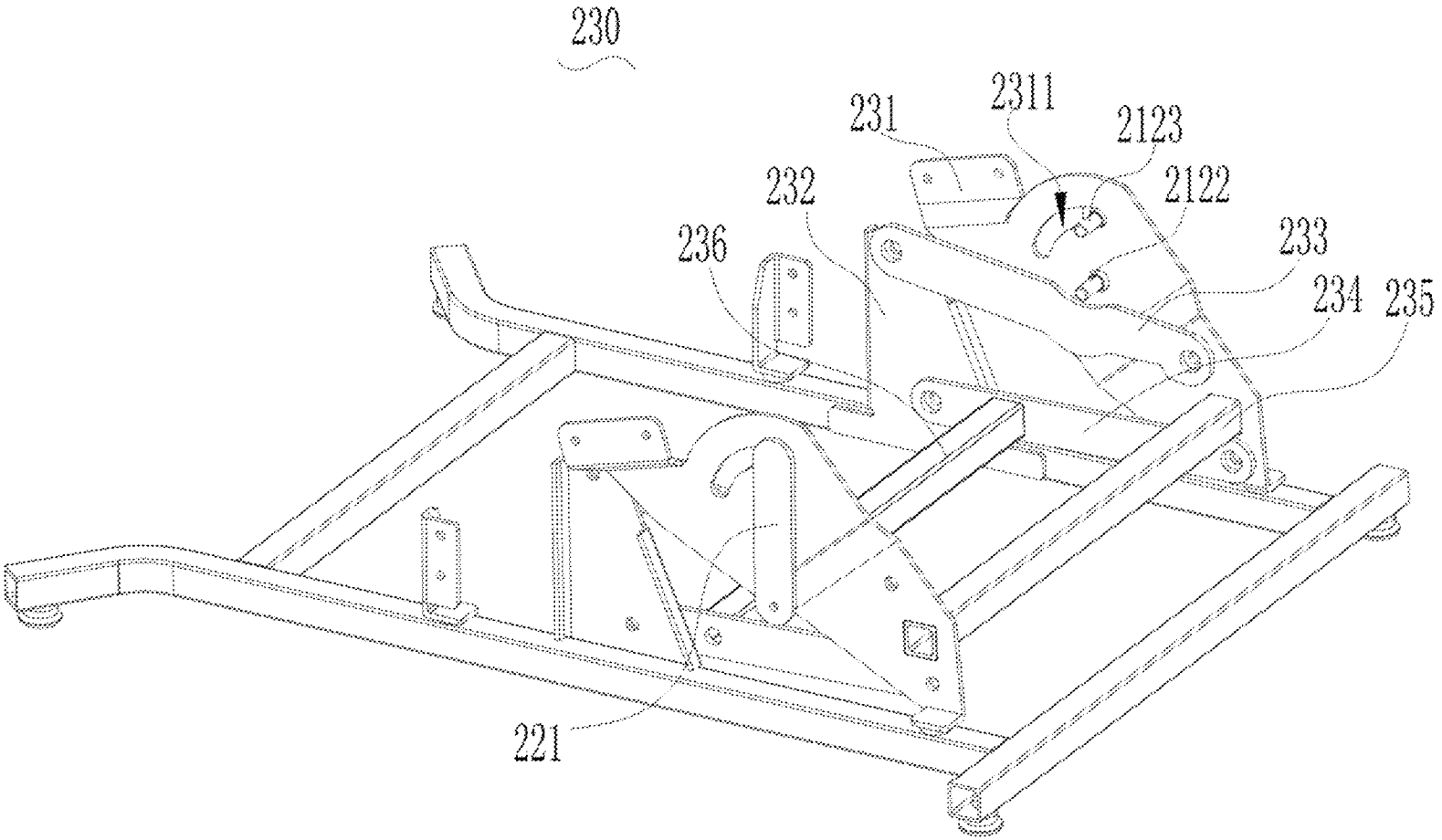
FIG. 4 is a structural schematic view of a lifting mechanism of a chair in another embodiment of the present disclosure.

FIG. 4 is a structural schematic view of a lifting mechanism 230 in another embodiment of the present disclosure.

In some embodiments, the lifting mechanism 230 can include a first substrate 231, a second substrate 232, a first lifting rod 233 and a second lifting rod 234. The first substrate 231 can be fixed to the chair support structure 10 via a fastener. Two ends of the first lifting rod 233 can be pivotally connected to the first substrate 231 and the second substrate 232, respectively. Two ends of the second lifting rod 234 can be pivotally connected to the first substrate 231 and the second substrate 232, respectively. The second substrate 232 can be connected to the base 310 of the chair 300. A first four-rod mechanism can be defined by the first substrate 231, the first lifting rod 233, the second lifting rod 234 and the second substrate 232. When the chair support structure moves towards the base 310 of the chair 300, the first lifting rod 233 and the second lifting rod 234 can fold relative to the second substrate 232. The first substrate 231 can abut against the top of the base 310 of the chair 300. At this time, the entire chair 300 can be in the lying state or the sitting state, and the footrest at the bottom of the chair support structure 10 can abut against the base 310 of the chair 300. The user's weight can be borne by the chair support structure 10 and the first substrate 231 together.

Figure 5:
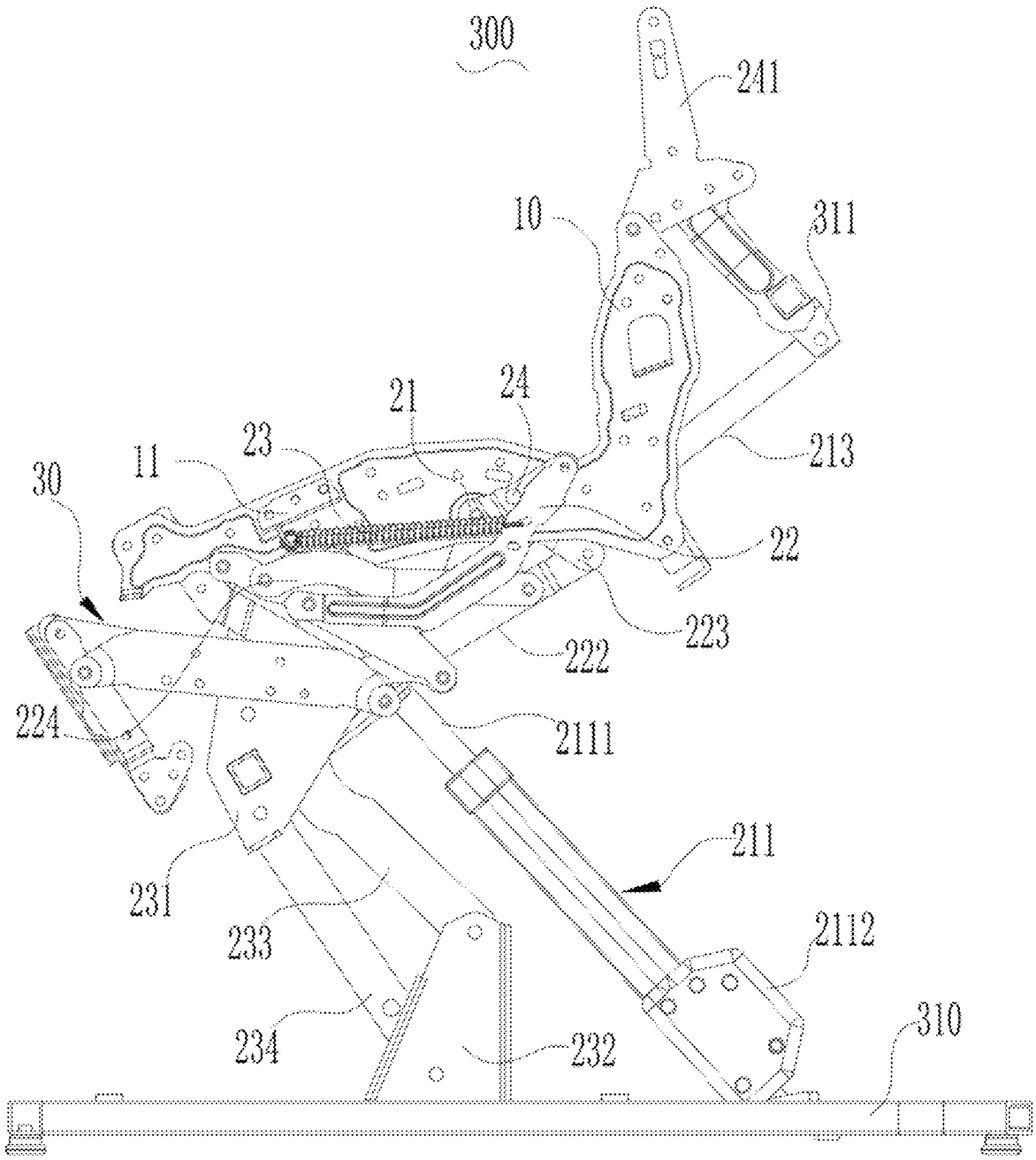
FIG. 5 is a structural schematic view of a chair in a standing state in another embodiment of the present disclosure.
Figure 6:
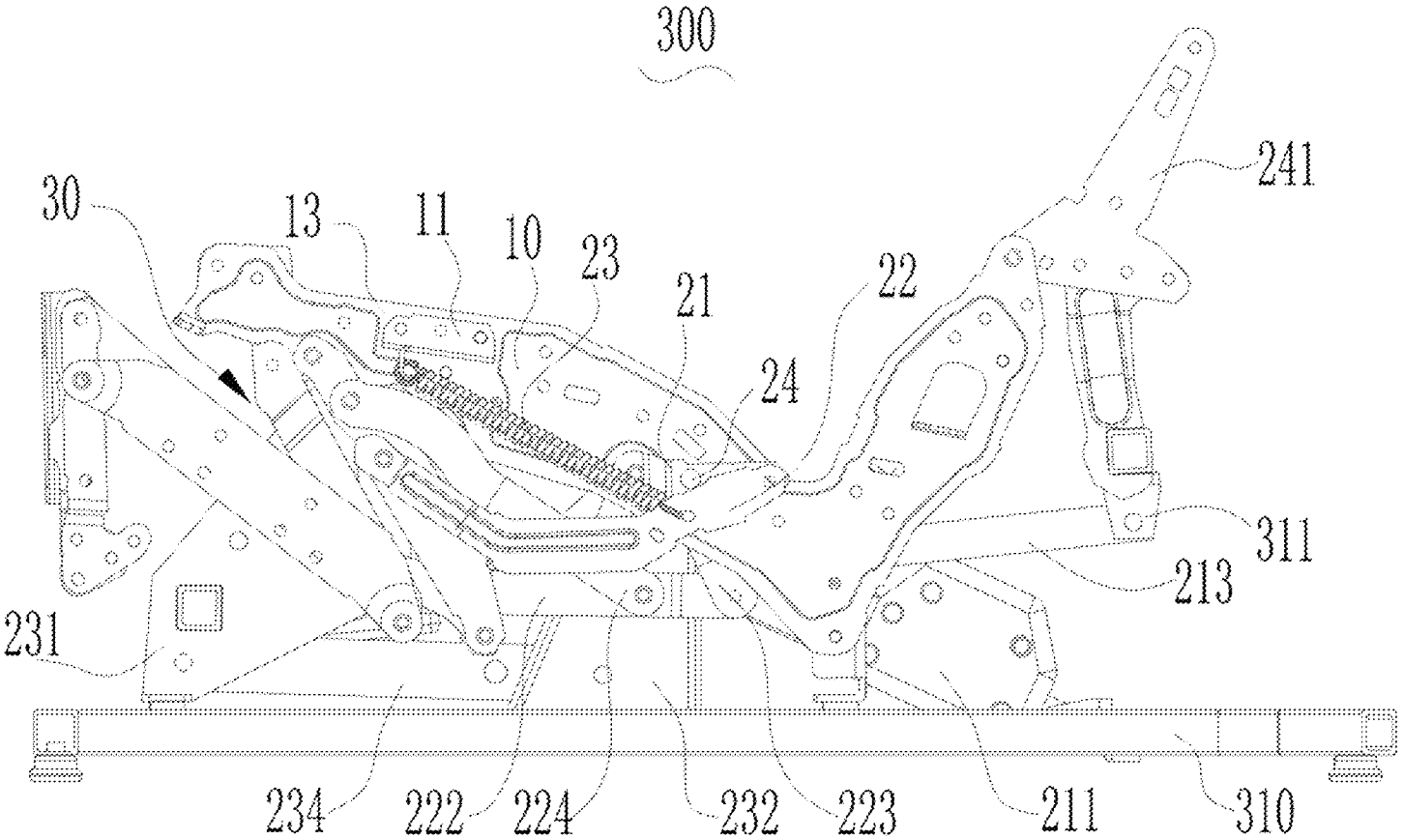
FIG. 6 is a structural schematic view of a chair in a sitting state in another embodiment of the present disclosure.
Figure 7:
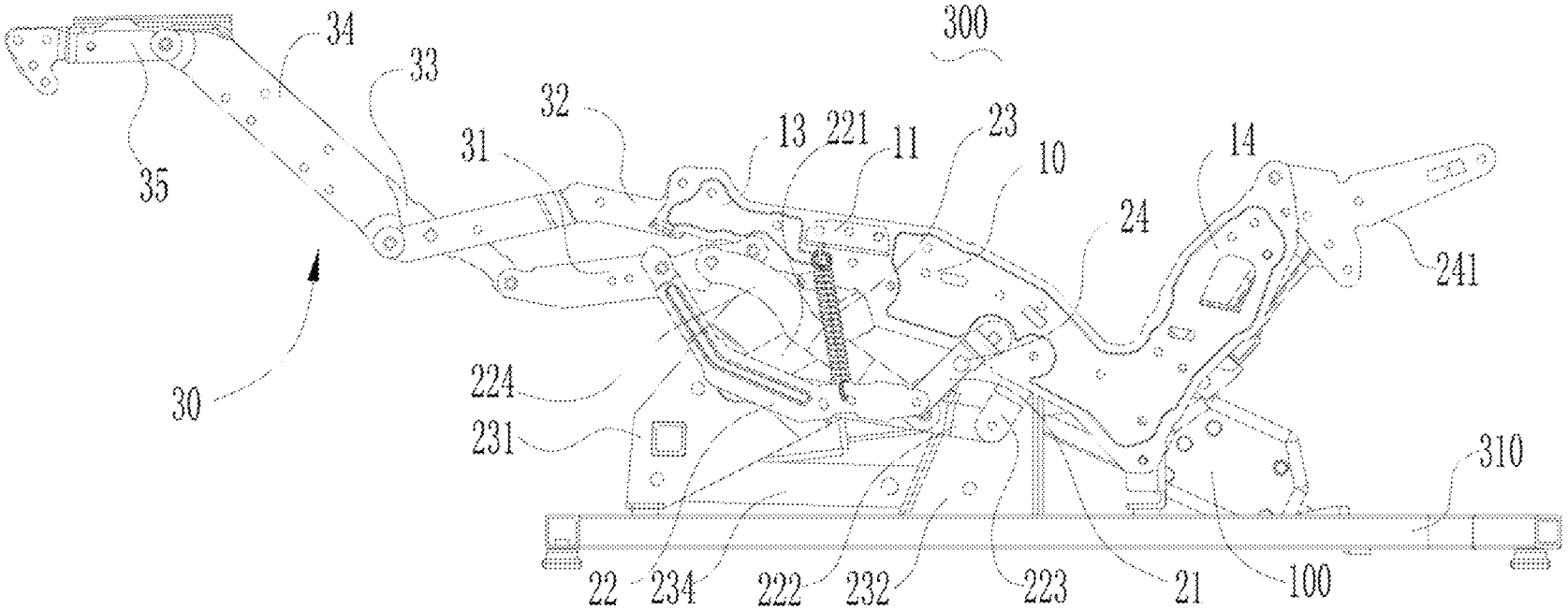
FIG. 7 is a structural schematic view of a chair in a lying state in another embodiment of the present disclosure.

FIG. 5 is a structural schematic view of a chair 300 in a standing state in another embodiment of the present disclosure, FIG. 6 is a structural schematic view of a chair 300 in a sitting state in another embodiment of the present disclosure, and FIG. 7 is a structural schematic view of a chair 300 in a lying state in another embodiment of the present disclosure.

When the user wants to leave the chair 300, the push rod 2111 can be driven by the chair driving motor 211 to extend along a direction extending out from the motor housing 2112, and drive the leg component 30 to contract; moreover, the locking component 20 can lock and maintain the relative position between the leg component 30 and the chair support structure 10. Then, the push rod 2111 can be driven by the chair driving motor 211 to continue extending out of the motor housing 2112. At this time, since the entire footrest mechanism 10 is static, the transmission component cannot continue to move and drive the leg component 30 to move. Therefore, the footrest mechanism, the chair support structure 10 and the transmission component can be fixed to each other. At this time, since the second pin-shaft 2123 of the first connecting rod 221 abuts against an inner wall at one end of the sliding groove, the driving force provided by the chair driving component can effect on the first substrate 231 via the first connecting rod 221. The entire first four-rod mechanism can be indirectly driven by the chair driving motor 211 to expand. Both the first lifting rod 233 and the second lifting rod 234 can rotate along the direction away from the base 310 relative to the second substrate 232. At the same time, the first substrate 231 is driven to move away from the base 310 of the chair 300, so that the first four-rod mechanism can expand and move away from the base 310. The first substrate 231 can drive the chair support structure 10, the leg component 30 and the transmission component to rise relative to the base 310. The chair 300 can be in the standing state, and the feet of the user can slowly touch down.

Correspondingly, when the user wants to use the chair 300, the push rod 2111 can be driven by the chair driving motor 211 to move along a direction contracting into the motor housing 2112. At the beginning, the relative position between the chair support structure 10, the footrest mechanism and the transmission component can be fixed. The driving force provided by the chair driving component can affect the first substrate 231 via the first connecting rod 221. The entire first four-rod mechanism can move towards the base 310 of the chair 300 and fold. The first lifting rod 233 and the second lifting rod 234 can rotate along a direction towards the base 310 relative to the second substrate 232. Therefore, the first substrate 231 can be driven to move towards the base 310, so that the chair 300 can be adjusted to the sitting state.

In some embodiments, the first sitting substrate 231 can be a forging plate, which is formed from a complete piece of plate material by forging and pressing at one time. The forging plate can have better rigidity and strength, which can better bear extruding force generated when the first lifting rod 233 and the second lifting rod 234 moves, and can be not easy to bend after being used in several times. In addition, when the chair 300 is in the lying state or the sitting state, the forging plate can ensure the first substrate 231 to reliably abut against a base 310 of the chair 300, making the first substrate 231 more stable and durable.

Furthermore, the transmission component can include a first connecting rod 221, a second connecting rod 222, a third connecting rod 223 and an energy output member 224. As the energy input terminal of the transmission component, the first connecting rod 221 can be pivotally connected to the lifting mechanism 231 and further connected to the chair driving motor 211 via being connected to the driving component 212. Two ends of the second connecting rod 222 can be pivotally connected to the first connecting rod 221 and the third connecting rod 223, respectively. An end of the third connecting rod 223 away from the second connecting rod 222 can be pivotally connected to the chair support structure. The energy output 224 can be the energy output terminal of the transmission component, and two ends of the energy output member 224 can be pivotally connected to the second connecting rod 222 and the first leg connecting rod 31, respectively.

A sliding groove can be disposed on the first substrate 231. The first connecting rod 221 can be provided with the first pin-shaft 2122 and the second pin-shaft 2123. The first pin-shaft 2122 can be penetrated through the first connecting rod 221 and the first substrate 231, and the first connecting rod 221 can be rotatably connected to the first substrate 231. The second pin-shaft 2123 can be penetrated through the sliding groove 2311, and can match with a slot of the sliding groove. When the first connecting rod 221 rotates relative to the first substrate 231 with an axis of the first pin-shaft 2122 as a center, the second pin-shaft 2123 can move in the sliding groove. That is, the sliding groove is an arc-shaped groove with the pivotal point of the first connecting rod 221 and the first substrate 231 as the center. A sector-shaped plate 2121 can be fixed to the end of the first linking element 212. The second pin-shaft 2123 can be penetrated through the sliding groove, and fixed to the sector-shaped plate 2121. Therefore, the first connecting rod 221 can be fixed to the first linking element 212, and the first linking element 212 can be connected to the first substrate 231. The chair driving motor 221 can drive the first linking element 212 to rotate with the pivotal point of the first connecting rod 221 and the first substrate 231 as the center. At the same time, the first linking element 212 can drive the first connecting rod 221 to rotate relative to the first substrate 231 with the axis of the first pin-shaft 2122 as the center. Therefore, the entire transmission component can be driven to move, so as to transmit the driving force provided by the chair driving motor 211 to the energy output member 224.

In some embodiments of the present disclosure, the chair 300 can include two sets of footrest mechanisms, transmission components and lifting mechanisms 230. The two set of transmission components can be fixed to the sector-shaped plate 2121 disposed at two ends of the first linking element 212 via the first connecting rod 221 of each transmission component, respectively. The two sets of transmission components can be pivotally connected to the first leg connecting rod 31 in each set of footrest mechanism via the energy output member 224 of each transmission component, respectively. Therefore, one chair driving motor 211 can drive the first linking element 212 to drive two sets of transmission components, so that the two sets of footrest mechanisms can correlatively move. The two sets of lifting mechanism 230 can be symmetrically disposed at two sides of the chair driving motor 211. The two sets of lifting mechanisms 230 can be fixed to the two chair support structures 10 in the two sets of footrest mechanisms with the fasteners via the first substrate 231 of each lifting mechanism 230. The chair driving motor 211 can drive the two sets of lifting mechanisms 230 to move correlatively via the two sets of transmission mechanisms, so that the two sets of lifting mechanisms 230 can synchronously expand or fold.

In some embodiments, a third linking element 235 and a fourth linking element 236 can be disposed between the two sets of lifting mechanisms 230. The third linking element 235 can be configured for connecting to the first substrate 231 in two sets of lifting mechanism 230. The linking element 236 can be configured for connecting the second lifting rod 234 in the two sets of lifting mechanisms 230. Moreover, in order to improve the integrality of the two sets of footrest mechanisms, a fixing member 12 of torsion resistance can be disposed between the two sets of footrest mechanisms, and two ends of the fixing member 12 can be fixed to two chair support structures 10, respectively.

Furthermore, the driving component can further include a backrest driving motor 213, which can be a push rod motor in some embodiments. The push rod motor can include a motor housing 2112 and the push rod 2111. The push rod 2111 can be the energy output terminal and disposed in the motor housing 2112, and the push rod 2111 can be extended out from or contracted back into the motor housing 2112. The motor housing 2112 can be pivotally connected to the U-shaped seat 311 fixed to the base 310. The chair support body can further include a backrest component, which can include a backrest element 241 and a second linking element 214. The backrest element 241 can be pivotally connected to the second support portion 14 of the chair support structure 10. The second linking element 214 can be fixed to the push rod 2111 via the U-shaped seat. The backrest element 241 and the second linking element 214 can be fixed together via the fastener. The backrest driving motor 213 can drive the back rest element 241 to rotate relative to the chair support structure 10 by driving the second linking element 214, so that an angle defined by the backrest (i.e., the angle defined by the backrest element 241 and the second support portion 14) can be adjusted.

In some embodiments of the present disclosure, the number of the backrest element 241 can be two. The two backrest elements 241 can be fixed to two ends of the second linking element 214, and can be pivotally fixed to two sets of chair support structures 10, respectively.

In the present disclosure, the footrest mechanism can be driven by the driving component and automatically locked. When the locking component 20 is driven by the leg component 30 to contract, the leg component 30 can be folded more firmly under the react of the locking component 20, and the leg component 30 can be maintained at a fixed position. This can avoid the leg component 30 to move relative to the chair support structure 10, and the using experience can be better. In addition, the leg component 30 can be further driven by the driving component. The locking component 20 can be driven by the leg component 30 to release the locking state of the leg component and the chair support structure. Therefore, the chair is more convenient to use.

The adjustment of the chair 300 in the present disclosure will be described hereinafter in conjunction with FIG. 5 to FIG. 7.

In FIG. 5, the chair 300 is in the standing state. The push rod 211 of the chair driving motor 211 can be extended to the longest. The leg component 30 can be contracted relative to the chair support structure 10. The locking component 20 can be maintained in the locking state. The positions between the footrest mechanism, the chair support structure 10 and the transmission component can be fixed. The lifting mechanism 230 can be extended. The first substrate 231 can be indirectly driven by the chair driving motor 211 and be raised by the first lifting rod 233 and the second lifting rod 234. The backrest driving motor 213 can be fixed to the chair support structure 10, and the backrest element 241 can fold relative to the chair support structure 10.

In FIG. 6, the chair 300 is in the sitting state. The push rod 2111 of the chair driving motor 211 can be contracted. The leg component 30 can be contracted relative to the chair support structure 10. The locking component 20 can be maintained in the contracting state. The footrest mechanism, the chair support structure 10 and the transmission component can be fixed to each other. The lifting mechanism 230 can folded. The first substrate 231 and the chair driving motor 211 can be indirectly driven by the chair driving motor, and lowered to the base 310 of the chair 300. At the same time, the footrest at the bottom of the chair support structure 10 can abut against the base 310. At this time, the user's weight can be borne by the first substrate 231 and the chair support structure 10 together. The backrest driving motor 213 can be still fixed to the chair support structure 10, and the backrest element 241 can be still folded relative to the chair support structure 10.

Referring to FIG. 7, the chair 300 is in the lying state. The push rod 2111 of the chair driving motor 211 can be continuously contracted to the shortest. The leg component 30 can be driven by the transmission mechanism to extend relative to the chair support structure 10, and raise the legs of the user up. At the same time, the locking rod 21 and the locking arm 22 move away from each other, so that the locking state between the leg component 30 and the chair support structure 10 can be released by the locking component.

The technical features of the above-described embodiments may be combined in any combination. For the sake of brevity of description, all possible combinations of the technical features in the above embodiments are not described. However, as long as there is no contradiction between the combinations of these technical features, all should be considered as within the scope of this disclosure.

The above-described embodiments are merely illustrative of several embodiments of the present disclosure, and the description thereof is relatively specific and detailed, but is not to be construed as limiting the scope of the disclosure. It should be noted that a number of variations and modifications may be made by those skilled in the art without departing from the spirit and scope of the disclosure. Therefore, the scope of the disclosure should be determined by the appended claims.

I claim:

1. A footrest mechanism, comprising a chair support structure, a locking component and a leg component, wherein the locking component comprises a locking rod, a locking arm and a locking elastic member, wherein the locking rod is provided with a locking and limiting structure; and when the locking rod and the locking arm are folded therebetween, the locking and limiting structure is configured for limiting the locking arm, the locking and limiting structure is a locking protrusion which is fixed on the locking rod and when the locking rod and the locking arm are folded therebetween, the locking protrusion abuts against the locking arm, wherein the locking arm is provided with a plurality of first connecting portions or a plurality of first connecting holes, each of the plurality of first connecting portions or each of a plurality of first connecting holes is configured for connecting to the locking elastic member; the chair support structure is provided with a fixing lug seat detachably fixed to the chair support structure; the fixing lug seat is provided with a plurality of second connecting portions or a plurality of second connecting holes, and each of a plurality of second connecting portion or each of a plurality of second connecting hole is configured for connecting to the locking elastic member, the locking rod is pivotally connected to the chair support structure, the locking arm is pivotally connected to the leg component and the locking rod, respectively, the locking elastic member is connected to the chair support structure and the locking arm, respectively; the locking arm can be locked to the chair support structure to define a locking state and the locking state can be maintained due to an elastic deformation of the locking elastic member;

the leg component is pivotally connected to the chair support structure and in a transmission connection with a driving component, and the leg component is capable of rotating relative to the chair support structure when the leg component is driven by the driving component;

the leg component has a contracting state and is capable of driving the locking arm to move towards the locking rod; the locking elastic member is capable of maintaining a relative position of the locking arm and the chair support structure; and the leg component further has an expanding state and is further capable of driving the locking arm to move away from the locking rod, resulting in release of the locking state of the locking arm and the chair support structure.

2. The footrest mechanism of claim 1, wherein the locking arm is provided with the locking and limiting structure; and when the locking rod and the locking arm are folded therebetween, the locking and limiting structure is configured for limiting the locking rod.

3. The footrest mechanism of claim 1, wherein the leg component is provided with a plurality of pivot locking holes, and each of a plurality of pivot locking holes is configured for pivotally connected to the locking arm.

4. A chair support body, comprising the driving component, a transmission component, a lifting mechanism and the footrest mechanism of claim 1, wherein the driving component is disposed on a base, and is in the transmission connection with the leg component via the transmission component; and the lifting mechanism is located to the base and fixed to the chair support structure.

5. The chair support body of claim 4, wherein the lifting mechanism comprises a first substrate, a second substrate, a first lifting rod and a second lifting rod; the first substrate is fixed to the chair support structure, two ends of the first lifting rod are pivotally connected to the first substrate and the second substrate, respectively, two ends of the second lifting rod are pivotally connected to the first substrate and the second substrate, respectively, and the second substrate is connected to the base; and a first four-rod mechanism is defined by the first substrate, the first lifting rod, the second lifting rod and the second substrate; when the first four-rod mechanism is driven by the driving component, and the first four-rod mechanism is capable of moving away from the base or moving towards the base.

6. The chair support body of claim 5, wherein the first substrate is a forging plate.

7. The chair support body of claim 5, wherein the driving component comprises the chair driving motor and the first linking element, the first linking element is pivotally connected to an output terminal of the chair driving motor and is cooperatively connected to the first substrate; the first linking element is driven by the chair driving motor to drive the first four-rod mechanism to expand or contract.

8. The chair support body of claim 4, wherein the transmission component comprises a first connecting rod, a second connecting rod, a third connecting rod and an energy output member; the first connecting rod is pivotally connected to the lifting mechanism and connected to the driving component; two ends of the second connecting rod are pivotally connected to the first connecting rod and the third connecting rod, respectively; an end of the third connecting rod away from the second connecting rod is pivotally connected to the chair support structure; and two ends of the energy output member are pivotally connected to the second connecting rod and the leg component, respectively.

9. The chair support body of claim 4, wherein the driving component further comprises a backrest driving motor, which is connected to the base;

the chair support body further comprises a backrest component, which is connected to and driven by the backrest driving motor; and the backrest component comprises a backrest element and a second linking element, wherein the backrest element is pivotally connected to the chair support structure and fixed to the second linking element, and the second linking element is pivotally connected to an output terminal of the backrest driving motor.

10. The chair support body of claim 4, wherein the chair support structure comprises two sets of lifting mechanisms, and the driving component is capable of driving the two sets of lifting mechanisms to correlatively expand or correlatively contract.

11. A chair, comprising the base and the chair support body of claim 4.

* * * * *